US011607602B2

(12) United States Patent
Avguštin et al.

(10) Patent No.: US 11,607,602 B2
(45) Date of Patent: Mar. 21, 2023

(54) FOLDING SKI

(71) Applicant: ELAN, d.o.o., Begunje na Gorenjskem (SI)

(72) Inventors: Vinko Avguštin, Žirovnica (SI); Andrej Hrovat, Radovljica (SI)

(73) Assignee: ELAN, d.o.o., Begunje na Gorenjskem (SI)

( * ) Notice: Subject to any disclaimer, the term of this patent is extended or adjusted under 35 U.S.C. 154(b) by 0 days.

(21) Appl. No.: 17/610,005

(22) PCT Filed: May 26, 2020

(86) PCT No.: PCT/IB2020/054959
§ 371 (c)(1),
(2) Date: Nov. 9, 2021

(87) PCT Pub. No.: WO2020/254893
PCT Pub. Date: Dec. 24, 2020

(65) Prior Publication Data

US 2022/0203209 A1 Jun. 30, 2022

(30) Foreign Application Priority Data

Jun. 18, 2019 (SI) ..... P-201900119

(51) Int. Cl.
*A63C 5/02* (2006.01)

(52) U.S. Cl.
CPC ..... *A63C 5/02* (2013.01); *A63C 2203/10* (2013.01)

(58) Field of Classification Search
CPC ..... A63C 5/02; A63C 2203/10
See application file for complete search history.

(56) References Cited

U.S. PATENT DOCUMENTS 4,632,418 A * 12/1986 Brue Moya ..... A63C 5/02 403/101
4,645,228 A 2/1987 Bertonneau
(Continued)

FOREIGN PATENT DOCUMENTS

SI 25117 A 7/2017
WO 2011/064598 A1 6/2011

OTHER PUBLICATIONS

International Search Report issued in PCT/IB2020/054959; dated Sep. 22, 2020.

*Primary Examiner* — Brian L Swenson
(74) *Attorney, Agent, or Firm* — Studebaker & Brackett PC

(57) ABSTRACT

The invention relates to a folding ski having an articulated connection. The technical problem is to configure a folding ski structure that will act as a classic ski, which means that the assembled structure of the folding ski will act as a uniform support. The folding ski of the invention comprises a ski front section, a ski rear section, an articulated connection that inseparably connects the ski front section with the rear section, a connecting plate intended to strengthen the articulated connection of the ski, the connecting plate comprising a front and rear base plate and a bridging plate, wherein a plurality of ribs and/or grooves in the shape of a circular arc are formed on the upper side of the front base plate and the rear base plate and a plurality of grooves and/or ribs are formed on the bottom side of the bridging plate so that each pair of a rib and a groove forms a positive lock connection that transfers longitudinal shear forces, and at least a part of the ribs is formed with at least one flap and the corresponding groove is formed with a notch which receives a flap so as to form a positive lock connection which also transfers vertical forces.

15 Claims, 3 Drawing Sheets

(56) References Cited

U.S. PATENT DOCUMENTS

Figure 1:
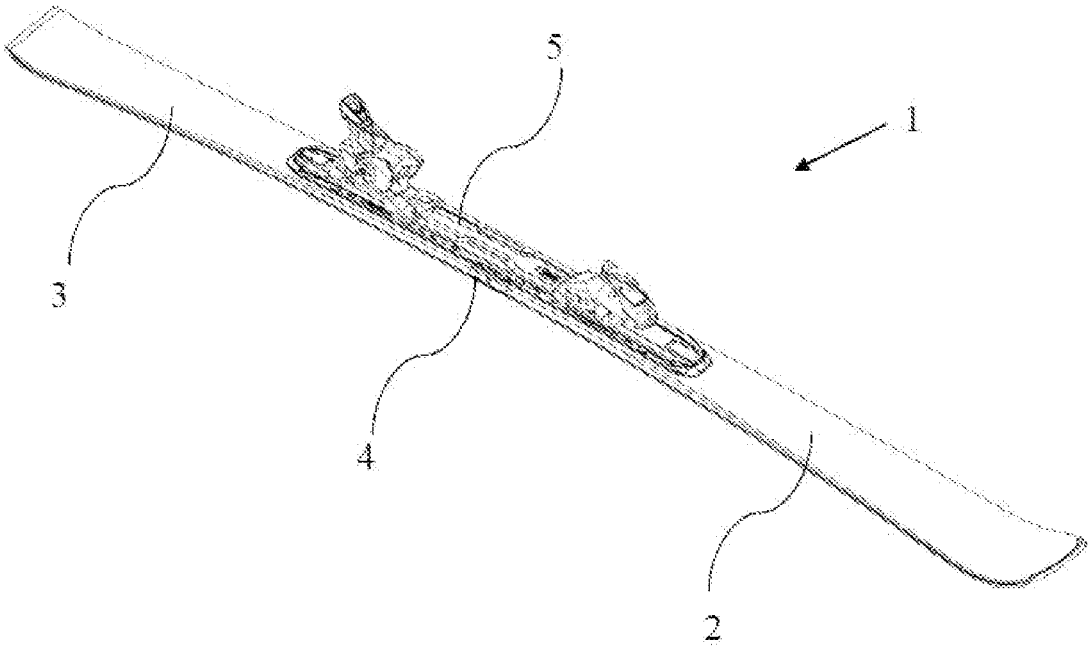

| | | | | |
|---|---|---|---|---|
| 6,616,170 | B1 * | 9/2003 | Quarti | A63C 5/02 280/607 |
| 10,328,330 | B2 * | 6/2019 | Avgustin | A63C 9/003 |
| 10,596,447 | B1 * | 3/2020 | Yi | F16C 11/10 |
| 11,167,199 | B2 * | 11/2021 | Avguštin | A63C 5/02 |
| 2004/0046363 | A1 * | 3/2004 | Emanuele | A63C 5/02 280/603 |
| 2012/0025508 | A1 * | 2/2012 | Green | A63C 5/02 280/809 |
| 2014/0217717 | A1 * | 8/2014 | Smith | E05D 7/00 16/349 |
| 2017/0216709 | A1 * | 8/2017 | Smith | A63C 5/02 |

* cited by examiner

FOLDING SKI

FIELD OF INVENTION

The invention relates to a folding ski for sporting or military activities.

PRIOR ART

A folding ski is known from prior art. When assembled, a folding ski functions as a classic ski, its advantage being its possibility of being folded and is as such handier for carrying, transporting and storing. A collapsible ski is disclosed in patent SI 25117. The ski comprises a ski front section having a front end with a tip and a rear end, and a ski rear section having a front end and a rear end with a tail, wherein the rear end of the ski front section is inseparably connected with the front end of the ski rear section by means of an articulated connection. The articulated connection is strengthened by a connecting plate engaging the grooves formed on the ski front and rear sections.

The articulated connection is located in the area of maximum bending moments. The purpose of the connecting plate is to lock the joint in the extended position of the ski, to connect the front and rear sections of the ski, to provide the required bending stiffness and other mechanical properties of the ski as exhibited by a classic ski, i. e. unfolding ski.

The connecting plate must be formed in such a way as to enable mounting of classic alpine ski bindings so that adjustment to different sizes of ski boots is possible. The alpine ski bindings are mounted to the connecting plate so that the front portion of the alpine ski binding is fixed to the connecting plate, while the rear portion of the alpine ski binding is attached to the connecting plate in a sliding way. This allows the ski to bend freely even in the sole area of the ski boot.

Technical Problem

The technical problem is to configure a folding ski structure that will act as a classic ski, which means that the assembled structure of the folding ski will act as a uniform support.

Solution to the Technical Problem

The relative expressions like front, rear, upper, lower etc. are defined herein from the perspective of the ski user when the ski is in its functional state.

The technical problem is solved with a folding ski comprising:

- a ski front section having a front end with a tip slightly bent upwards, and a rear end
- a ski rear section having a front end and a rear end with a tail slightly bent upwards,
- an articulated connection which inseparably connects the rear end of the ski front section to the front end of the ski rear section,
- a connecting plate intended to strengthen the articulated connection of the ski in its functional state, the connecting plate comprising a front base plate fixed to the rear end of the ski front section, a rear base plate fixed to the front end of the ski rear section, a bridging plate that is articulated hinged to the front base plate or the rear base plate and is pivotal around a pivot axis extending perpendicularly to the ski upper surface, said bridging plate being arranged such that the transverse central axis of the bridging plate is approximately in the area of the articulated connection when the ski is in its functional state,
- wherein a plurality of ribs and/or grooves in the shape of a circular arc are formed on the upper side of the front base plate and the rear base plate and a plurality of grooves and/or ribs are formed on the bottom side of the bridging plate so that each pair of ribs and grooves forms a positive lock connection that transfers shear forces in the longitudinal direction of the ski, and at least a part of the ribs is formed with at least one flap projecting in the longitudinal direction of the ski, and the corresponding groove is formed with a notch which receives a flap so as to form a positive lock connection which transfers vertical forces in addition to longitudinal shear and compressive forces.

The vertical parts of the ribs transfer longitudinal forces and the daps transfer the vertical forces.

The advantage of the folding ski according to the invention over known folding skis is that the connecting plate does not allow vertical and longitudinal movements between the base plates and the bridging plate of the connecting plate. An efficient transfer of forces between the bridging plate and the base plates without longitudinal movements strengthens the ski in the area of the articulated connection to the extent that it acts as a uniform support and provides good bending stiffness. A further advantage is that the plates with grooves and ribs are not mounted on the ski directly as in known folding skis, the grooves and ribs are formed on the base plates, thus reducing the possibility, of mounting errors when manufacturing the ski.

Figure 2:
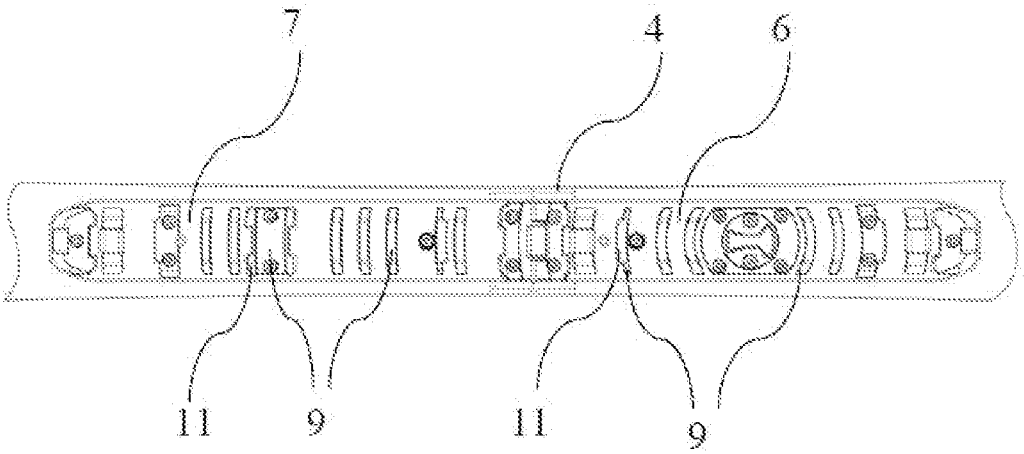
Figure 3:
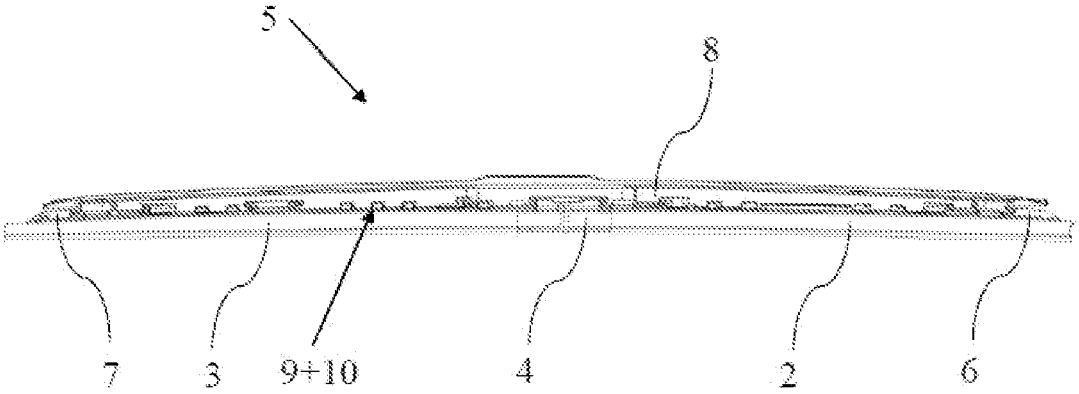
Figure 4:
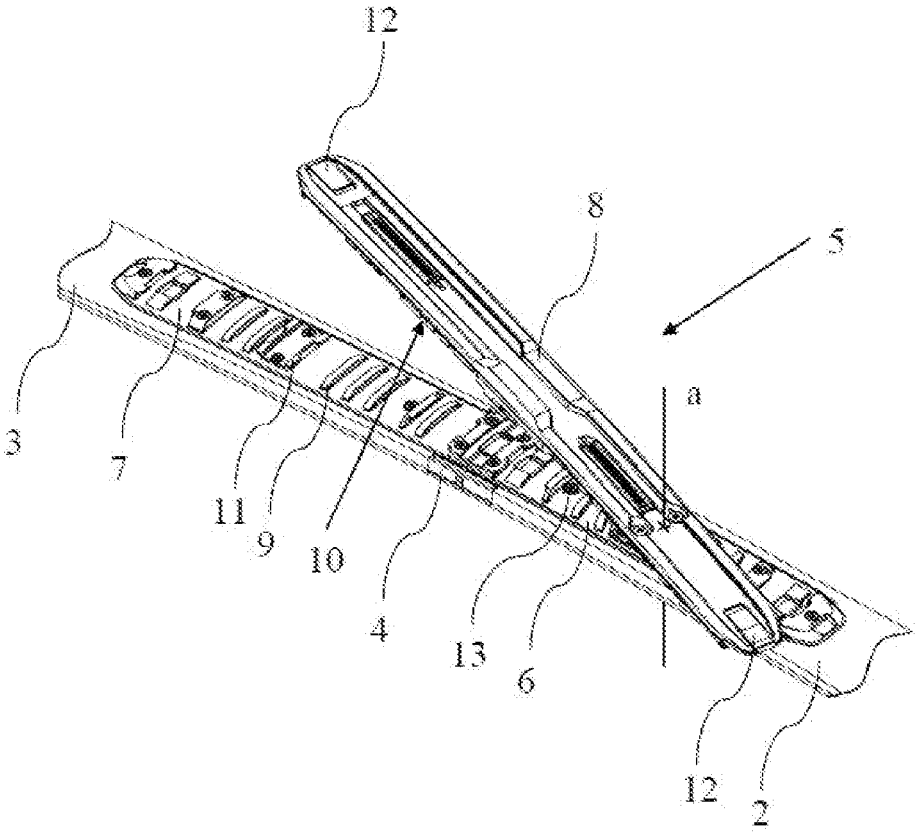
Figure 5:
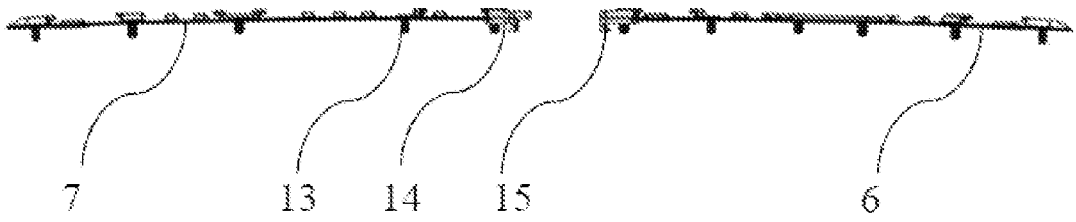
Figure 6:
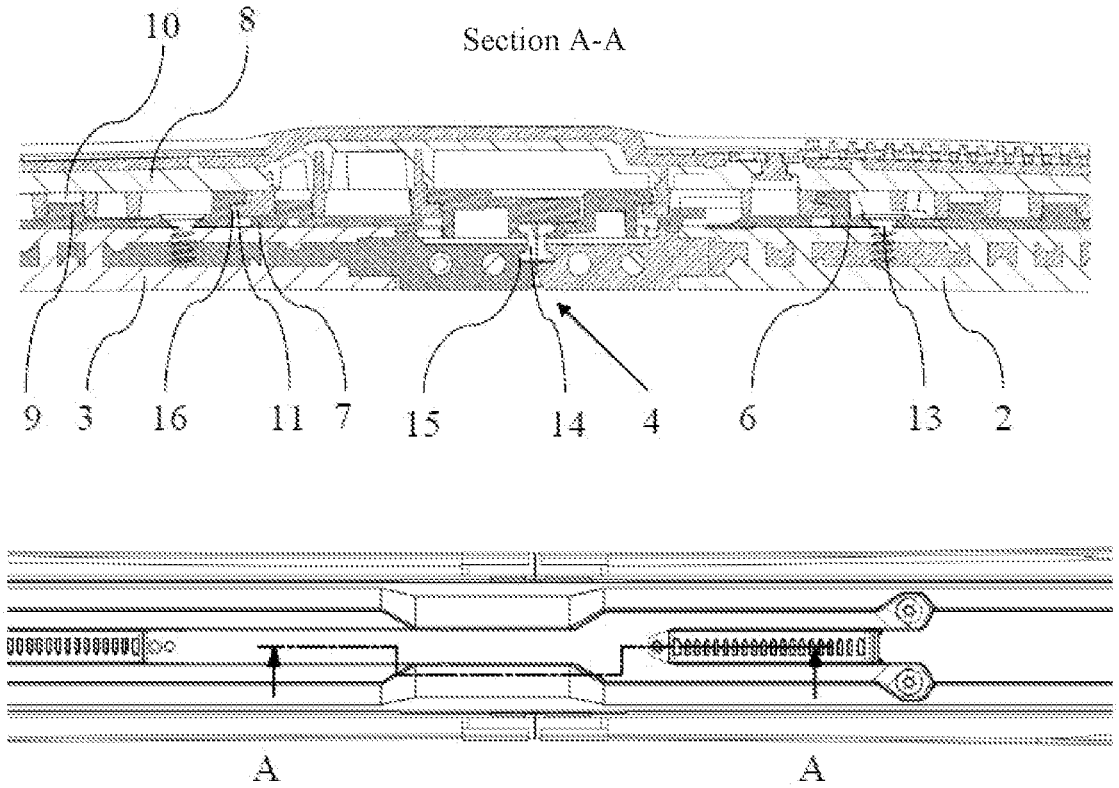

FIG. 1: Folding ski with a connecting plate and bindings in a functional state FIG. 2: Front and rear base plates fastened on the folding ski FIG. 3: Folding ski with a connecting plate, side view FIG. 4: Folding ski with a connecting plate, the bridging plate being pivoted with respect to the base plates FIG. 5: Base plates with a profile, side view FIG. 6: Ski with a connecting plate in the area of the articulated connection, cross-sectional view The invention is described in more detail in the following.

The technical problem is solved with a folding ski 1 comprising:

- a ski front section 2 having a front end with a tip slightly bent upwards, and a rear end,
- a ski rear section 3 having a front end and a rear end with a tail slightly bent upwards,
- an articulated connection 4 which inseparably connects the rear end of the ski front section to the front end of the ski rear section,
- a connecting plate 5 intended to strengthen the articulated connection of the ski in its functional state, the connecting plate comprising a front base plate 6 fixed to the rear end of the ski front section, a rear base plate 7 fixed to the front end of the ski rear section, a bridging plate 8 that is hinged to the front base plate or the rear base plate and is pivotal around a pivot axis a extending perpendicularly to the ski upper surface, said bridging plate being arranged such that the transverse central axis of the bridging plate is approximately in the area of the articulated connection when the ski is in its functional state, wherein a plurality of ribs 9 and/or grooves in the shape of a circular arc are formed on the upper side of the front base plate 6 and the rear base plate 7 and a plurality of grooves 10 and/or ribs are formed on the bottom side of the bridging plates so that each pair of a rib 9 and a groove 10 forms a positive lock connection that transfers shear forces in the longitudinal direction of the ski, and at least a part of the ribs is formed with at least one flap 11 projecting in the longitudinal direction of the ski, and the corresponding groove is formed with a notch 16 which receives a flap 11 so as to form a positive lock connection which transfers vertical forces in addition to longitudinal shear and compressive forces.

The circular arc of the groove side closer to the pivot axis a is formed by a radius extending from the pivot axis a or a slightly smaller radius, and the circular arc of the corresponding rib side is formed by a radius extending from the pivot axis a or a slightly larger radius.

The circular arc of the rib side more distant from the pivot axis a is formed by a radius extending from the pivot axis a or a slightly smaller radius, and the circular arc of the corresponding groove side is formed by a radius extending from the pivot axis a or a slightly larger radius.

The radii of the circular arcs are selected in a way that the distance between the adjacent sides of a rib and a groove, which are in engagement, in the area of the central longitudinal axis of the ski is minimal, e. g. about 0.2 mm, and the distance between adjacent sides of a rib and a groove, which are in engagement, at the edge of the ski is greater than the minimum, e. g. about 0.8 mm.

Greater clearance between the respective adjacent sides of a groove and a rib ensures easier insertion of the ribs into the grooves when strengthening the ski with the bridging plate.

The ski further comprises a locking mechanism 12 that locks the bridging plate when the ski is in the functional position.

The bridging plate can be made of aluminium. Alternatively, the bridging plate may be made of injection-moulded plastic reinforced with fibres, in particular carbon fibres or glass fibres. The bridging plate may be further reinforced with a layer of fibre fabric, in particular carbon fibres or glass fibres. The advantage of a bridging plate made of plastic over that of aluminium is more than a halved weight of the bridging plate. Furthermore, the bridging plate can be formed of two different plastic materials by a two-component injection moulding process. The core of the bridging plate can thus be made of injection-moulded plastic having better mechanical properties, such as carbon-fibre reinforced polyamide, while the core is enclosed by an injection-moulded plastic having poorer mechanical properties (cheaper material), such as glass-fibre reinforced polyimide.

The base plates are fixed to the ski by screws 13. Alternatively, the base plates are fixed to the ski by an adhesive or rivets.

The base plates 6, 7 are provided at their ends facing the articulated connection 4 with a profile 14 having a tooth 15 which engages a respective part of the articulated connection 4. The profile 14 is formed of aluminium.

The invention claimed is:

1. A folding ski comprising:

a ski front section having a front end with a tip slightly bent upwards, and a rear end, a ski rear section having a front end and a rear end with a tail slightly bent upwards, an articulated connection which inseparably connects the rear end of the ski front section to the front end of the ski rear section, a connecting plate intended to strengthen the articulated connection of the ski in its functional state, the connecting plate comprising a front base plate fixed to the rear end of the ski front section, a rear base plate fixed to the front end of the ski rear section, a bridging plate that is hinged to the front base plate or the rear base plate and is pivotal around a pivot axis extending perpendicularly to the ski upper surface, said bridging plate being arranged such that the transverse central axis of the bridging plate is approximately in the area of the articulated connection when the ski is in its functional state, wherein a plurality of ribs and/or grooves in the shape of a circular arc are formed on the upper side of the front base plate and the rear base plate and a plurality of grooves and/or ribs are formed on the bottom side of the bridging plate so that each pair of a rib and a groove forms a positive lock connection that transfers shear forces in the longitudinal direction of the ski, and at least a part of the ribs is formed with at least one flap projecting in the longitudinal direction of the ski, and the corresponding groove is formed with a notch which receives a flap so as to form a positive lock connection which transfers vertical forces in addition to longitudinal shear and compressive forces.

2. The folding ski according to claim 1, wherein the circular arc of the groove side closer to the pivot axis is formed by a radius extending from the pivot axis or a slightly smaller radius, and the circular arc of the corresponding rib side is formed by a radius extending from the pivot axis or a slightly larger radius.

3. The folding ski according to claim 2, wherein the radii of the circular arcs are selected in a way that the distance between the adjacent sides of a rib and a groove, which are in engagement, in the area of the central longitudinal axis of the ski is about 0.2 mm, and the distance between adjacent sides of a rib and a groove, which are in engagement, at the edge of the ski is about 0.8 mm.

4. The folding ski according to claim 1, wherein the circular arc of the rib side more distant from the pivot axis is formed by a radius extending from the pivot axis or a slightly smaller radius, and the circular arc of the corresponding side of the groove is formed by a radius extending from the pivot axis or a slightly larger radius.

5. The folding ski according to claim 1, wherein the ski further comprises a locking mechanism that locks the bridging plate when the ski is in the functional position.

6. The folding ski according to claim 1, wherein the bridging plate is formed of aluminium.

7. The folding ski according to claim 1, wherein the bridging plate is formed of injection-moulded plastic reinforced with fibres.

8. The folding ski according to claim 7, wherein the bridging plate is reinforced with a layer of fibre fabric.

9. The folding ski according to claim 8, wherein the fibre fabric is made of carbon fibres or glass fibres.

10. The folding ski according to claim 7, wherein the fibres are carbon fibres or glass fibres.

11. The folding ski according to claim 1, wherein the bridging plate is formed of two different plastic materials by a two-component injection moulding process, the core of the bridging plate being formed of injection-moulded plastic having better mechanical properties while the core is enclosed by an injection-moulded plastic having poorer mechanical properties.

12. The folding ski according to claim 11, wherein the core of the bridging plate is formed of carbon-fibre reinforced polyamide, while the core is enclosed by glass-fibre reinforced polyamide.

13. The folding ski according to claim 1, wherein the base plates are fixed to the ski by screws or attached to it by an adhesive or rivets.

14. The folding ski according to claim 1, wherein the base plates are provided at their ends facing the articulated connection with a profile having a tooth which engages a respective part of the articulated connection.

15. The folding ski according to claim 14, wherein the profile is formed of aluminium.

* * * * *